US006330812B2

(12) United States Patent
Mostello

(10) Patent No.: US 6,330,812 B2
(45) Date of Patent: Dec. 18, 2001

(54) METHOD AND APPARATUS FOR PRODUCING NITROGEN FROM AIR BY CRYOGENIC DISTILLATION

(76) Inventor: Robert Anthony Mostello, 165 Rehill Ave., Somerville, NJ (US) 08876

( * ) Notice: Subject to any disclaimer, the term of this patent is extended or adjusted under 35 U.S.C. 154(b) by 0 days.

(21) Appl. No.: 09/775,362

(22) Filed: Feb. 1, 2001

Related U.S. Application Data

(60) Provisional application No. 60/186,572, filed on Mar. 2, 2000.

(51) Int. Cl.[7] ..... F25J 3/04
(52) U.S. Cl. ..... 62/643
(58) Field of Search ..... 62/643, 654, 648

(56) References Cited

U.S. PATENT DOCUMENTS 4,337,070 * 6/1982 Rohde ..... 62/643
4,717,410 1/1988 Grenier .
5,098,457 3/1992 Cheung et al. .
5,341,646 * 8/1994 Agrawal et al. ..... 62/643
5,761,927 * 6/1998 Agrawal et al. ..... 62/643
5,768,914 * 6/1998 Xu et al. ..... 62/648
5,916,261 * 6/1999 Bonaquist et al. ..... 62/643
5,956,972 * 9/1999 Naumovitz ..... 62/643
6,196,022 * 3/2001 Horst et al. ..... 62/643

* cited by examiner

*Primary Examiner*—William C. Doerrler

(57) ABSTRACT

Nitrogen gas at a single pressure is produced from a two-column cryogenic distillation of air. The bottoms liquid product from the high pressure column is divided into portions, at least one of which does not enter the low pressure column as a feed stream. By these means, a portion of an oxygen-rich stream is removed from the distillation, further enhancing nitrogen recovery and achieving low specific energy consumption for nitrogen product.

15 Claims, 2 Drawing Sheets

METHOD AND APPARATUS FOR PRODUCING NITROGEN FROM AIR BY CRYOGENIC DISTILLATION

CROSS-REFERENCE TO RELATED APPLICATION

This application is entitled to the benefit of Provisional Patent Application Ser. No. 60/186,572 filed Mar. 2, 2000.

FIELD OF THE INVENTION

The present invention is directed to the cryogenic separation of air by distillation for the production of primarily gaseous nitrogen.

BACKGROUND ART

Nitrogen is among the most heavily produced and used chemicals. It finds application in the petroleum, glass, foods, electronics, pharmaceutical, and metals industries. Cryogenic separation of air is a principal means of producing nitrogen.

Cryogenic air separation plants, chiefly for the production of gaseous nitrogen, exist in a number of configurations. These, in turn, group around single distillation column and double distillation column designs. There are many variations of these designs in each category. In most cases the objective is to produce nitrogen at the lowest energy consumption for any given delivery pressure; but aspects such as capital cost and particular features of convenience are equally important.

A simple single-column system has a relatively low nitrogen recovery, the balance of the air being discharged as an impure product containing a substantial amount of nitrogen. Means have been suggested in more complex designs for increasing the nitrogen recovery in such systems and reducing the amount of energy required per unit of product nitrogen.

Two-column systems have inherently greater nitrogen recoveries than simple single-column systems. Nevertheless, simple two-column systems do not necessarily have lower unit energy requirements than improved single column systems. Well-designed systems of either configuration compete for lowest unit energy consumption. The elements of energy consumption, capital cost, and particular convenient features remain important considerations.

OBJECT OF THE INVENTION

An object of the invention is to provide a process for a two-column cryogenic distillation of air which achieves high nitrogen recovery, low unit energy consumption, and, though nitrogen is produced by each distillation column operating at different pressures, the product gaseous nitrogen is delivered at a single pressure, a desirable and convenient feature, while maintaining high nitrogen recovery and low unit energy consumption.

SUMMARY OF THE INVENTION

Double distillation column systems which are designed to produce principally nitrogen have the following requirements:

1. The condenser condensing nitrogen overheads from the high pressure column must boil a stream which boils at a temperature lower than said nitrogen condensing temperature.
2. A vapor stream resulting from the aforementioned boiled stream which enters the low pressure column for further separation must be at or above the operating pressure of the low pressure column.
3. The pressure of the low pressure column must be high enough such that at least a portion of the nitrogen overheads from the low pressure column can be condensed in a condenser against a boiling stream which boils at a colder temperature than the condensing nitrogen overheads. This boiling stream can be the bottoms liquid product from the low pressure column which is reduced in pressure upon entry into the condenser.

It can be seen then that such a system described above becomes easier to effect as the pressure difference between the high pressure column and the reduced pressure derived from the bottoms product from the low pressure column becomes greater. This pressure difference, or some function of this pressure difference, when coupled with the quantity of nitrogen actually recovered, has a direct impact on the requisite energy to produce a nitrogen product. A greater pressure difference indicates a higher energy consumption.

Another feature desirable but not essential to such processes is the recovery of all or most of the nitrogen at the pressure of the high pressure column, where part of the reflux made in the low pressure column condenser is pressurized and returned as additional reflux to the high pressure column.

The current invention improves on this process by conducting the condensation of vapors at the pressure of the high pressure column, all of which may be the overhead vapor from the high pressure column, in at least two stages of coolant vaporization in series. The composition of the boiling stream becomes richer in oxygen as the extent of vaporization increases. At essentially a constant temperature of vaporization, the first stage of vaporization occurs at a higher pressure and the second stage at a lower pressure. The vapor from the first stage is both richer in nitrogen and higher in pressure than the vapor from the second stage, and constitutes a feed to the low pressure column. Therefore, the pressure of the low pressure column is maximized—a desirable effect for a given high pressure column pressure, and oxygen is preferentially rejected from the column system from the second stage condenser. Because the composition of the liquid bottoms from the low pressure column are related to the composition of the vapor feed to the bottom of the low pressure column, these bottoms are richer in nitrogen and vaporize at a colder temperature when transferred to the low pressure column condenser and reduced in pressure, allowing the low pressure and high pressure columns to operate at pressures closer together. The low pressure column condenser typically operates just above atmospheric pressure. The effects of reducing head pressure and rejecting an oxygen-rich mixture from the second or last stage of the high pressure column condenser lead to lower compression energy and higher nitrogen recovery, which minimize unit energy expenditure for the nitrogen produced.

DETAILED DESCRIPTION OF THE INVENTION

Figure 1:
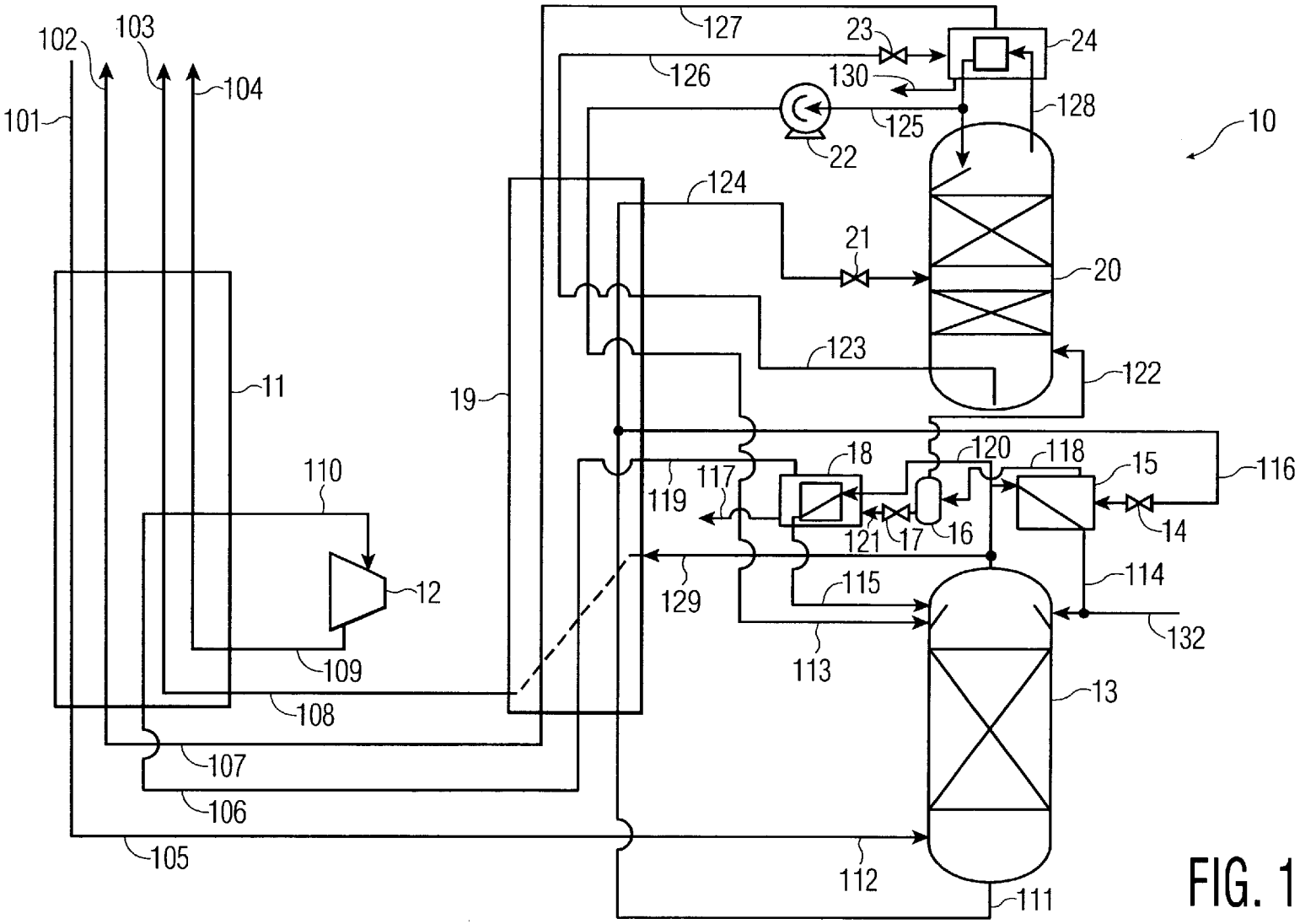
FIG. 1 is a schematic representation of the preferred embodiment of the invention.

Referring to FIG. 1, air is compressed and cooled and the water condensate removed before entering typically an adsorption unit for the removal of residual water vapor, carbon dioxide, and other amounts of trace contaminants. The air 101 then enters the main heat exchanger 11, where it is cooled to a temperature near its dew point (typically with a small liquid content), while products of the subsequent distillation—pure nitrogen 108 and waste nitrogen 107 streams enter as cold vapors at the opposite end and are warmed, receiving heat from the air which is being cooled. In some cases a small part of the air 105 may be liquefied and may be removed separately from the balance of the air which remains in vapor state. A reheat stream 106 composed of a second waste nitrogen stream also enters the cold end of the main heat exchanger and is partially warmed, before being withdrawn as 110 for expansion in turboexpander 12.

After the air leaves the main heat exchanger, it enters the bottom section of the high pressure column 13. The high-pressure distillation column is composed of trays or packing to effect mass transfer between the rising vapor and the downflow of liquid. The vapor becomes richer in nitrogen as it rises. The residual oxygen content of the vapor at the top of the column can be below 1 part per billion or 0.5% or higher.

Part of the nitrogen vapor is condensed in condensers 15 and 18 in indirect heat trasfer with a coolant for return to the column as reflux streams 114 and 115, i.e. the liquid column flow which scrubs the oxygen out of the rising vapor. The balance of the nitrogen vapor 129 is removed from the high pressure column for warming in heat exchangers 19 and 11 and delivery as product 103 at pressure or to be further compressed in a product compressor.

The liquid bottoms product 111 from the high pressure column is composed of oxygen, nitrogen, and argon, and is typically termed "rich liquid" or "crude oxygen". The rich liquid enters subcooler 19 and is divided into the coolant stream 116 which is routed to the nitrogen condensers 15 and 18 and a feed stream 124 to the low pressure column 20 after further subcooling in subcooler 19.

Rich liquid 116 is throttled across valve 14 to a pressure low enough to reduce its vaporization temperature below the condensing temperature of nitrogen and enters condenser 15 where it is partially vaporized, as nitrogen vapor is condensed to make reflux for the high pressure column. Rich liquid 116 is partially boiled in condenser 15 and liquid and vapor phases are separated in separator 16. The residual liquid from condenser 15 has a higher oxygen content than the rich liquid feed to condenser 15. In order to vaporize the balance of this residual rich liquid, its pressure and temperature must be lowered still by throttling valve 17 which passes the residual rich liquid to condenser 18, where it is all or nearly all vaporized. Nitrogen vapor from the high pressure column is also condensed in condenser 18 and becomes part of the reflux to the high pressure column.

The vaporized rich liquid from separator 16 is fed to the bottom of the low pressure column 20. This rich liquid vapor was vaporized at essentially the operating pressure of the low pressure column. The balance of the rich liquid which was passed to condenser 18 is vaporized, is partially warmed in subcooler 19 and main heat exchanger 11 and turboexpanded in 12 to produce refrigeration. The turboexpander exhaust gas 109 is warmed in subcooler 19 and main heat exchanger 11 and may be used elsewhere or vented to atmosphere. This is a stream of elevated oxygen content; and therefore, its disposition in this manner assists in the separation of the air to make the nitrogen product.

The low pressure column 20 is a mass transfer device, also constructed of trays or packing, and processing liquid and vapor streams, as described above. The part of the rich liquid stream 124 fed to an intermediate point in the low pressure column has part of its nitrogen content stripped out by the vapor rising from the bottom of the low pressure column. The resulting liquid reaching the bottom of the low pressure column 123 is transferred to the condenser for the low pressure column after being subcooled in subcooler 19 and reduced in pressure at valve 23. This stream serves as the coolant for condensing the nitrogen overhead vapor from the low pressure column in condenser 24. The vaporized coolant 127is passed through subcoolers 19 and main heat exchanger 11, which recover its refrigeration, and may be used for regeneration of the air purification adsorber, for instance.

All the nitrogen vapor 128 which is produced in the low pressure column is condensed. Part of the condensate is returned as reflux to the low pressure column; and the remainder 125 is pumped by pump 22 to the pressure of the high pressure column, passed through subcooler 19, and injected into the high pressure column as additional reflux.

Figure 2:
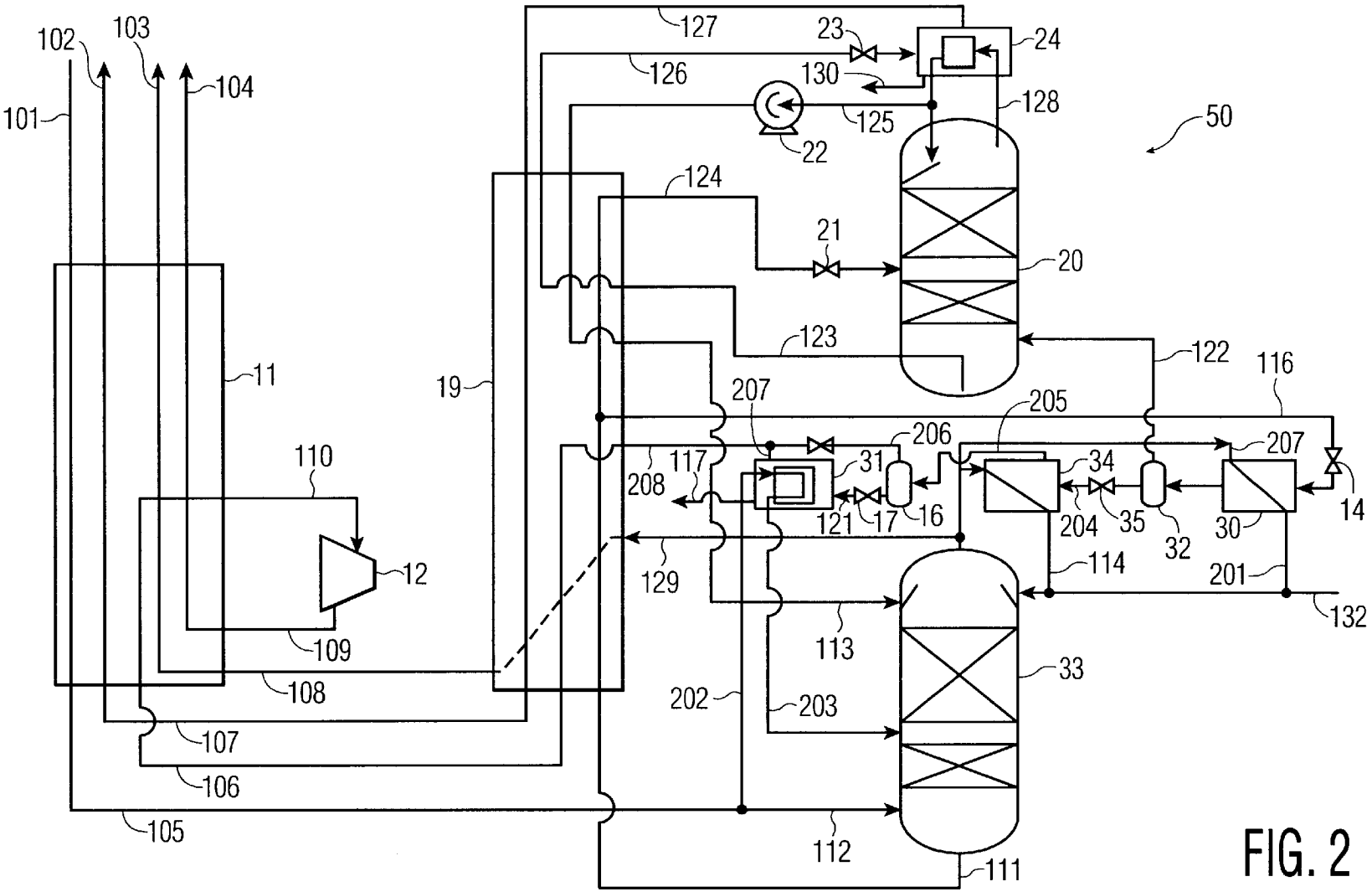
FIG. 2 is a schematic of another embodiment of the invention which has the capability to generate more refrigeration and entails more capital cost than the embodiment of FIG. 1.

Another embodiment of the invention is shown in FIG. 2. In this embodiment three condensers are employed for condensing reflux liquids primarily for the high pressure column. The purpose of such an arrangement is to vaporize the last portion of the rich liquid coolant 116 utilizing air as the heating medium in condenser 31. In so doing, since air at approximately the pressure of the high pressure column 33 condenses at a higher temperature than nitrogen at the pressure at the top of the high pressure column, the last portion of rich liquid 209 which vaporizes in condenser 33 can vaporize at a higher pressure by being heated against air than against nitrogen. A higher pressure stream 208, composed of streams 206 from condenser 34 and 207 from condenser 31, is available for turboexpansion and production of additional refrigeration, for instance, for achieving a greater production of liquid nitrogen product, if desired.

Liquid air 203 produced in condenser 31 is routed principally to the high pressure column 33 for assisting the distillation there. Depending on overall distillation requirements, some liquid air may be routed to low pressure column 20.

In other respects the process embodiment in FIG. 2 is similar to that of FIG. 1.

Example

A process for the recovery of substantially pure nitrogen at a rate of 2687 Nm3/hr at a pressure of 4.9 atma is conducted in accordance with FIG. 1. Nm3/hr refers to the flow rate of a substance measured as a gas at 0 C. and 1 atma. C. refers to temperature in degrees Celsius; atma refers to pressure in absolute atmospheres. K refers to temperature in degrees Kelvin.

A feed air flow of 4632 Nm3/hr was compressed to a pressure of 5.2 atma, aftercooled to about ambient temperature, its water condensate removed, and passed to an adsorption unit for removal of water and carbon dioxide, and possibly other contaminants. The purified air 101 was passed to main heat exchanger 11 where it was cooled to approximately its dew point, producing a small amount of liquid. Air 105 entered the bottom of high pressure column 13 at 98.6 K and 5.05 atma. The high pressure column is internally made up of structured packing for mass transfer.

Gaseous nitrogen at a 94.1 K and 5.0 atma exited from the top of the high pressure column, and a portion was forwarded to subcooler 19 where it was warmed to 95.4 K, and further warmed in main heat exchanger 11 to ambient temperature. Nitrogen product exited the plant at 4.9 atma with an oxygen content of 5 vpm (parts per million by volume). The product constituted a 58% recovery based on the total air delivered to the cold box.

The balance of the gaseous nitrogen which exited from the top of the high pressure column was condensed in condensers 15 and 18 and returned to the top of the high pressure column as reflux.

The bottoms liquid product 111 exited from the high pressure column and had an oxygen concentration of 40%. This stream was subcooled to 96 K in subcooler 19 and then divided. The first part 116 at a flow rate of 1830 Nm3/hr was throttled in valve 14 to 3.05 atma and was passed to condenser 15, 1058 Nm3/hr was vaporized and sent to the bottom of the low pressure column as stream 122. The remaining liquid was throttled via valve 17 to 2.1 atma before entering condenser 18 as coolant. This remaining liquid was not totally vaporized in order to limit the concentrations of non-volatile contaminants. Stream 119 had a composition of about 51.5% oxygen. Stream 119 was warmed to 95.4 K in subcooler 19 and further warmed in main heat exchanger 11 to 120 K and passed to turboexpander 12 for expansion to 1.04 atma and 101.7 K. The exhaust stream 109 then was passed to the main heat exchanger where it was warmed to about ambient temperature.

The second part of rich liquid stream 111 was further subcooled to 91.9 K and stream 124 was reduced in pressure by valve 21 and fed to the low pressure column 20.

The bottoms liquid product 123 from the low pressure column was subcooled in 19, throttled via valve 23 to 1.2 atma, and introduced as coolant of condenser 24 . The vaporized coolant 127 had a flow rate of 888 Nm3/hr and contained 49.7% oxygen. This stream was not totally vaporized in order to limit the concentration of non-volatile contaminants. The nitrogen vapor 128 flow rate to condenser 24 was 1013 Nm3/hr and was totally condensed and a portion was returned to the low pressure column as reflux. The remaining liquid nitrogen 125 at a flow rate of 482 Nm3/hr was first passed to pump 22, which pumped the liquid to the pressure of the high pressure column. Stream 125 was then warmed in subcooler to 93.9 K and added to the reflux flow of the high pressure column.

It is possible to produce a small amount of liquid product by withdrawing to storage liquid nitrogen at 132, for instance. It is also possible to add liquid nitrogen at, for instance, 132, to assist in supplying the refrigeration needs of the plant.

It is also possible to recover more than 60% of the air as nitrogen at the same pressure of feed air by modification of the operating and plant design conditions, requiring somewhat larger heat transfer equipment.

While particular embodiments of this invention have been described, it will be understood, of course, that the invention is not limited thereto, since many obvious modifications can be made; and it is intended to include within this invention any such modifications as will fall within the scope of the invention as defined by the appended claims.

I claim:

1. A process for the distillation of air consisting of two distillation columns, a high pressure column and a low pressure column, where:

a. the bottoms liquid product of the high pressure column is divided into a first part which feeds the low pressure column; and a second part which serves as coolant for condensing at least one vapor stream from the high pressure column which is returned to the high pressure column as a reflux stream b. the vaporization of said coolant takes place serially in at least two coolant vaporization stages each of which condenses vapor c. the composition of said coolant becomes richer in its higher boiling components as said coolant vaporizes in subsequent stages d. the vaporized coolant from the last stage of vaporization does not re-enter the distillation column process, and e. all of said vaporized coolant from the initial stage of vaporization enters the low pressure distillation column f. at least one coolant vaporization stage is used to condense nitrogen overhead vapor from the high pressure column.

2. The process of claim 1 where the bottoms liquid product of the low pressure column is reduced in pressure and serves as coolant to the condenser of the low pressure column.

3. The process of claim 1 where gaseous nitrogen overhead from the low pressure column is condensed in the low pressure column condenser and divided into a first part which is returned as reflux to the low pressure column and a second part which is pumped to higher pressure and returned as reflux to the high pressure column.

4. The process of claim 1 where gaseous nitrogen overhead from the high pressure column, which is not condensed in the high pressure column condensers, is withdrawn as the gaseous nitrogen product.

5. The process of claim 1 where the coolant stream is the bottoms product from the high pressure column and the condenser of the high pressure column is composed of two stages of coolant vaporization, each of which condenses part of the nitrogen vapor overheads from the high pressure column.

6. The process of claim 1 where the coolant stream is the bottoms product from the high pressure column and condenses the nitrogen vapor overheads from the high pressure columns in one or two stages and where the final vaporization of coolant is effected by condensing air which upon condensation is subsequently fed to the high pressure column, the low pressure column, or both.

7. The process of claim 1 where the vaporized coolant stream from the low pressure column condenser is warmed to ambient temperature in heat exchangers to recover its refrigeration.

8. The process of claim 1 where the vaporized coolant from the last or latter stage or stages of vaporization is turboexpanded to produce refrigeration and then is warmed to ambient temperature in heat exchangers to recover its refrigeration.

9. The process of claim 1 where the gaseous nitrogen product is warmed to ambient temperature in heat exchangers to recover its refrigeration.

10. The process of claim 1 where streams which are warmed, in turn are used to cool incoming air.

11. The process of claim 1 where the vaporized coolant from the second stage of coolant vaporization is removed from the distillation system.

12. The process of claim 1 where the vaporized coolant removed from the second stage of vaporization is turboexpanded to generate refrigeration.

13. A process for the distillation of air consisting of two distillation columns, as described in claim 1, where refrigeration can be supplied either by turboexpanding said vaporized coolant from the last or a latter stage of coolant vaporization, by liquid-assisting with an external cryogenic refrigerant, or by a combination of both.

14. The process for the distillation of air as described in claim 1 in which the pressure of the compressed air to the high pressure column is less than 5.44 atmospheres absolute.

15. An apparatus for the production of nitrogen from air comprising:

a. equipment for compressing and purifing air;

b. heat exchange means for cooling air and warming products of air separation;

c. two distillation columns of higher and lower pressure for the separation of air by cryogenic distillation;

d. at least two condensers are employed for condensing vapors at higher pressure column pressure in which a coolant is vaporized, becoming richer in its higher boiling components, condensing at least nitrogen overhead vapor;

e. means for returning condensed nitrogen vapor to higher pressure column as reflux;

f. means for withdrawing nitrogen vapor from the higher pressure column as nitrogen product of the plant g. means for transferring condensed additional streams, such as air, to higher pressure column, lower pressure column, or both h. means for transference of part of a bottom liquid product of the high pressure column to the at least two condensers employed for condensing vapors;

i. means for transference of part of a bottom liquid product of the higher pressure column to the lower pressure column;

j. means for turboexpansion of vapor derived from one or more condensers of the higher pressure column, if desired;

k. means of supplying supplementary or total refrigeration to the process by addition of a liquid cryogen, if desired;

l. means for transference of the liquid bottoms product of the lower pressure column to the condenser of the lower pressure column to effect condensation of the overhead nitrogen vapor of the lower pressure column;

m. means for pumping part of the condensed overhead vapor from the lower pressure column to sufficient pressure and then for injecting said part into the higher pressure column;

n. means for returning part of condensed overhead vapor from low pressure column back to the low pressure column as reflux.

* * * * *